US011016521B2

(12) United States Patent
Elliot

(10) Patent No.: US 11,016,521 B2
(45) Date of Patent: May 25, 2021

(54) PEDAL CAP AND SUPPORT THEREFOR

(71) Applicant: BENTLEY MOTORS LIMITED, Crewe (GB)

(72) Inventor: Gary Stephen Elliot, Whitchurch (GB)

(73) Assignee: Bentley Motors Limited, Crewe (GB)

( * ) Notice: Subject to any disclaimer, the term of this patent is extended or adjusted under 35 U.S.C. 154(b) by 299 days.

(21) Appl. No.: 16/067,285

(22) PCT Filed: Jan. 23, 2017

(86) PCT No.: PCT/GB2017/050160
§ 371 (c)(1),
(2) Date: Jun. 29, 2018

(87) PCT Pub. No.: WO2017/134417
PCT Pub. Date: Aug. 10, 2017

(65) Prior Publication Data

US 2020/0285264 A1 Sep. 10, 2020

(30) Foreign Application Priority Data

Feb. 2, 2016 (GB) ..... 1601871

(51) Int. Cl.
*G05G 1/483* (2008.04)

(52) U.S. Cl.
CPC ..... *G05G 1/483* (2013.01)

(58) Field of Classification Search
CPC ..... G05G 1/30; G05G 1/48; G05G 1/483
See application file for complete search history.

(56) References Cited

U.S. PATENT DOCUMENTS

| | | | | |
|---|---|---|---|---|
| 1,449,990 A | | 3/1923 | Grund et al. | |
| 1,455,675 A | | 5/1923 | Sinclair | |
| 1,810,625 A | | 6/1931 | Rouse | |
| 1,918,918 A | * | 7/1933 | Lambert | G05G 1/487 74/563 |
| 1,918,919 A | * | 7/1933 | Lambert | G05G 1/487 74/563 |
| 1,977,415 A | | 10/1934 | Thorp | |
| 2,069,066 A | | 1/1937 | Harbour | |
| 2,674,669 A | | 4/1954 | Leedam | |
| 5,321,995 A | | 6/1994 | Zedan | |

(Continued)

FOREIGN PATENT DOCUMENTS

| | | |
|---|---|---|
| CH | 431291 A | 8/1967 |
| DE | 413756 | 10/1924 |

(Continued)

*Primary Examiner* — Adam D Rogers
(74) *Attorney, Agent, or Firm* — Schwabe Williamson & Wyatt, P.C.

(57) ABSTRACT

A pedal cap comprises a foot pad having a forward surface and a rear surface; the forward surface facing the foot of a user, in use. The pedal cap includes two side portions extending rearwardly from the foot pad, away from the forward surface, each side portion comprising latch members which latch behind the head of a pedal. At each end of the pedal cap, lips are provided. At one end, the lip has an inwardly extending flange, whereas the lip at the other end may be provided with or without an inwardly extending flange. A support for supporting the pedal cap during insertion of the head of a pedal is also provided.

19 Claims, 4 Drawing Sheets

(56) References Cited

U.S. PATENT DOCUMENTS

Figure 1A:
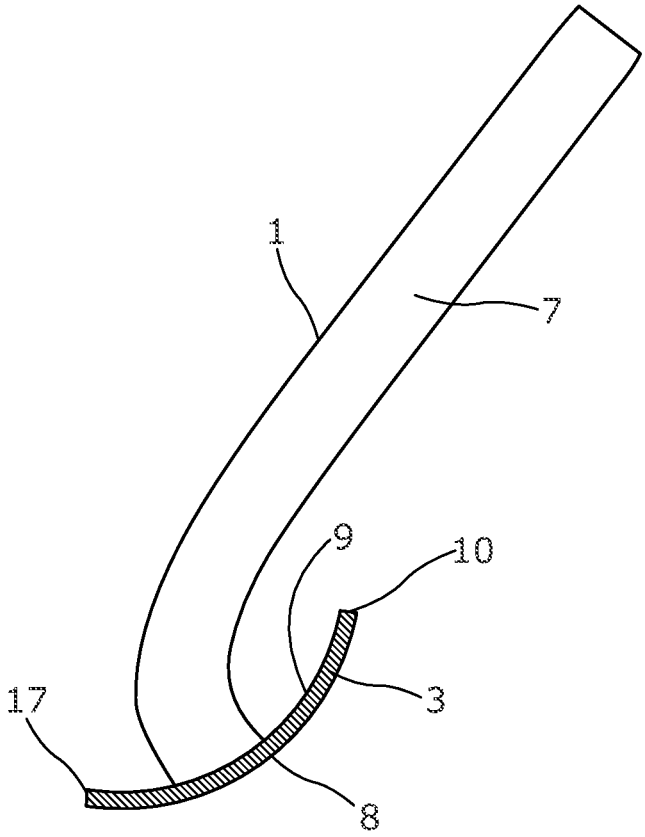

| | | | | |
|---|---|---|---|---|
| D372,448 | S * | 8/1996 | Holst | D12/174 |
| 5,884,534 | A | 3/1999 | Knoll et al. | |
| 6,439,754 | B1 * | 8/2002 | Lin | B60K 26/02 340/457.3 |
| 8,656,805 | B2 * | 2/2014 | Palacio Arguelles | B60T 7/06 74/560 |
| 9,870,019 | B2 * | 1/2018 | Kelly | G05G 1/483 |
| 2003/0154818 | A1 | 8/2003 | Lee | |

FOREIGN PATENT DOCUMENTS

| | | | | |
|---|---|---|---|---|
| DE | 29703179 | U1 * | 4/1997 | G05G 1/483 |
| DE | 10357166 | A1 * | 6/2005 | B60T 7/06 |
| DE | 10357166 | A1 | 6/2005 | |
| EP | 1816538 | A1 * | 8/2007 | G05G 1/483 |
| EP | 1816538 | A1 | 8/2007 | |
| FR | 1265372 | A * | 6/1961 | G05G 1/483 |
| FR | 1501883 | A * | 11/1967 | B60K 26/02 |
| FR | 2956910 | A1 | 9/2011 | |
| GB | 1555211 | A | 11/1979 | |
| GB | 2450626 | A | 12/2009 | |
| JP | 2050731 | U1 | 4/1990 | |
| JP | H11152073 | A | 6/1999 | |
| JP | 2006294057 | A | 10/2006 | |
| KR | 200148196 | Y1 * | 6/1999 | |
| KR | 200148196 | Y1 | 6/1999 | |
| KR | 100890995 | B1 | 3/2009 | |
| KR | 101282634 | B1 * | 7/2013 | |

* cited by examiner

PEDAL CAP AND SUPPORT THEREFOR

CROSS-REFERENCE TO RELATED APPLICATION

This application is a 371 U.S. National Stage of International Application No. PCT/GB2017/050160, filed Jan. 23, 2017, entitled "PEDAL CAP AND SUPPORT THEREFOR," which designated, among the various States, the United States of America, and which claims priority to GB 1601871.5, filed Feb. 2, 2016, both of which are hereby incorporated by reference.

TECHNICAL FIELD OF THE INVENTION

The present invention relates to a pedal cap, a method of attaching a pedal cap to a pedal, a pedal comprising such a pedal cap and an automobile comprising such a pedal. It also relates to a support for use in attaching the pedal cap to a pedal. In particular, the invention relates to a pedal cap having latches to attach to a pedal plate.

BACKGROUND TO THE INVENTION

Automobiles (and other vehicles) are frequently provided with pedals, such as accelerator, brake and (optionally) clutch pedals which a driver presses in order to control the vehicle. Such pedals are typically formed of a metal arm and an integral, or attached, metal plate, which is actuated to operate the vehicle.

Since the early days of motoring, the disadvantages of pressing directly on a metal plate have been known. Against that background, U.S. Pat. Nos. 2,069,066, 1,977,415, 1,810,625 and 1,455,675 all propose pads/caps, e.g. of rubber to cover the pedal plate. U.S. Pat. Nos. 2,069,066, and 1,810,625 both suggest providing an inwardly extending flange at the rim of the pedal cap, into which the pedal plate is manipulated. This technique remains the standard method for connecting a pedal pad to a pedal plate to this day, despite the fact that manipulating the plate into the inwardly extending flange is a difficult job even in the factory (usually requiring specialist tooling to open up the cap) and especially difficult for the service dealer or home-mechanic.

Introducing the plate into the pocket formed by the flange produces stresses on the plate, but since in general the plate is of metal, it can normally withstand these forces. U.S. Pat. Nos. 1,977,415 and 1,455,675 propose alternative methods of attaching pedal caps, using clamping jaws, or pliable tongues, but these methods of attachment have not found favour in the industry. This is considered to be in part due to the requirement again for specialist tooling for fitting and also the design restrictions imposed by the required position and function of the jaws/tongues.

Despite the ubiquity of the technique of forming an integral inwardly turned flange around the entire periphery, formed from the resilient material of the cap, alternatives have been proposed, even as recently as 2007 in EP1816538, which suggests inserting studs through holes formed in the pedal. This, however, is a more expensive technique, requiring several components and additional machining of the pedal plate to provide the holes. Again, it has not been popular, as a straightforward, and cheap solution exists.

The solution of EP1816538 would be particularly unsuitable for more modern pedals formed in one part from carbon-fibre/glass-fibre composites and the like. These composite pedals take unusual profiles, aimed at reducing material except where it is absolutely necessary in view of the forces they will encounter in use. Drilling holes though composites can substantially weaken them and such composite pedals should ideally have plates designed to maximise strength in service, rather than to accept the stresses of forcing the plate into the pocket of a pedal cap.

The present invention seeks to provide an improved pedal cap, preferably suited for pedals formed of composites and preferably one which overcomes the problems mentioned above.

SUMMARY OF THE INVENTION

According to a first aspect of the invention, there is provided a pedal cap comprising a foot pad having a forward surface and a rear surface; the pedal cap further comprising at least one side portion extending rearwardly from the foot pad, away from the forward surface, the side portion comprising at least one latch member.

In use, the forward surface of the foot pad faces the driver's foot, and the rear surface faces the front surface of the head of a pedal (or pedal plate); and when applying the pedal cap, pushing the head of the pedal past the side portion, towards the rear surface of the pedal cap causes the latch member to retract, and once the rear surface of the cap abuts the head of the pedal, the at least one latch member engages behind the rear surface of the pedal.

The pedal cap may comprise two side portions. The two side portions may be formed on opposing lateral sides of the pedal cap.

The or each side portion may be inwardly curved, e.g. slightly inwardly curved.

The or each side portion may comprise a plurality of latch members, for example, 2, 3, 4 or more latch members.

The or each latch member may be formed of a resilient material. Alternatively, the or each latch member may be resiliently biased, for example by a helical spring.

The pedal cap may be formed of a resilient material. The pedal cap may be formed entirely from a plastics material, for example from rubber or an elastomer. The latch members may be integral with the pedal cap. The pedal cap may be a moulding. The latch members may be formed integrally with the pedal cap, for example as the latch members may form an integral part of a plastic moulding (e.g. a rubber or elastomer moulding) comprising the foot pad and at least one side portion.

The or each latch member may be wedge shaped.

The or each latch member may be pyramidal.

The or each latch member may be hollow.

The or each latch member may be formed with tapering sidewalls so as to cause the latch member to bulge outwards when compressed.

The or each latch member may be provided with bracing walls so as to cause the latch member to bulge outwards when compressed. The bracing walls may be integral with the pedal cap, optionally formed as part of a plastic moulding (e.g. a rubber or elastomer moulding).

The pedal cap may comprise a lip member at one or two ends of the pedal cap. The or each lip member may be integral with the pedal cap, optionally formed as part of a plastic moulding (e.g. a rubber or elastomer moulding).

The pedal cap may be generally rectangular, having two (lateral) sides and two ends.

At least one (or each) lip member may be an inturned lip member comprising an inwardly extending flange, which is preferably integral with the pedal cap, optionally formed as part of a plastic moulding (e.g. a rubber or elastomer moulding). At least one (or each) lip member may be an upturned lip member, formed without an inwardly extending flange.

Where both ends comprise lip members, one may be inturned, comprising an inwardly extending flange and the other may be upturned, i.e. formed without an inwardly extending flange.

Alternatively, both lip members may comprise inwardly extending flanges, in this case, if the foot pad is substantially curved, it could become difficult to insert the head of the pedal into the cap. However, the presence of at least one side member with at least one latch thereon makes it easier than in the prior art where the entire periphery is formed with an inwardly extending flange.

A preferred embodiment includes a lip having an (integrally formed) inwardly extending flange at one end, a lip without an inwardly extending flange at the other end and two side portions extending between the lips, each provided with a plurality of resilient latch members.

Especially if the foot pad is curved, this arrangement provides a strong connection whilst being easy to apply to the head of the pedal; first one end of the head of the pedal is inserted into the space behind the inwardly extending flange, then the pedal is rotated to bring the rear surface of the foot pad into abutment with the front surface of the pedal, with the latches retracting, then engaging over the course of the rotation. The inwardly extending flange and the latches restrict the cap from being pulled off the pedal.

The pedal cap may be curved.

The curve of the pedal cap may be concave, i.e. the rear surface may be concave and the forward surface may be convex.

The curve of the pedal cap have a cross sectional shape substantially constituting a segment of a circle. The segment may be less than a quarter of a circle. Where an inturned lip and an upturned lip are provided, if the segment is more than a quarter of a circle and an inturned lip and up upturned lip are provided it will be more difficult to insert the pedal into the pedal cap. The segment may be less than an eighth of a circle. Where both lips are inturned, if the segment is greater than an eighth of a circle it becomes more difficult to introduce the head of the pedal into the pedal cap.

The upturned lip and the inwardly extending flange of the inturned lip may be substantially parallel.

According to a second aspect of the invention there is provided a kit of parts, the kit comprising a pedal cap according to the first aspect of the invention and a pedal cap support; wherein the pedal cap support has a rear face conforming to the shape of the forward surface of the pedal cap.

The pedal cap support may comprise an upstanding lip arranged to support an upstanding or inturned lip of the pedal cap.

The pedal support may comprise an inturned lip arranged to support an upstanding or inturned lip of the pedal cap.

According to a third aspect of the invention there is provided a method offitting a pedal cap according to the first aspect of the invention to the head of a pedal; the method comprising supporting the pedal cap in a pedal cap support as defined in the second aspect of the invention and pressing the head of the pedal past at least one latch on the side portion of the pedal cap, so as to secure the pedal cap to the head of the pedal.

The method may comprise supporting the pedal cap in a pedal cap support, wherein the pedal cap has an inwardly turned lip and the inturned lip is inserted into an inturned lip of the support; the method comprising inserting one end of the head of the pedal into the inturned lip of the pedal cap and rotating the pedal such that the head passes the or each latch and is whereby the latches engage behind the rear surface of the pedal.

DETAILED DESCRIPTION OF THE INVENTION

Figure 1B:
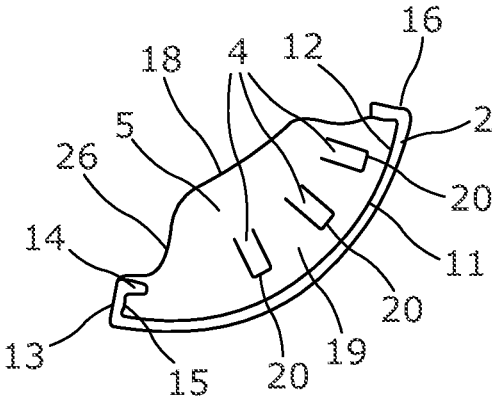
Figure 1C:
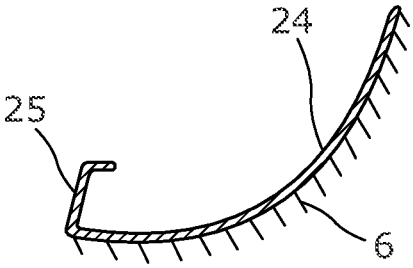
Figure 2A:
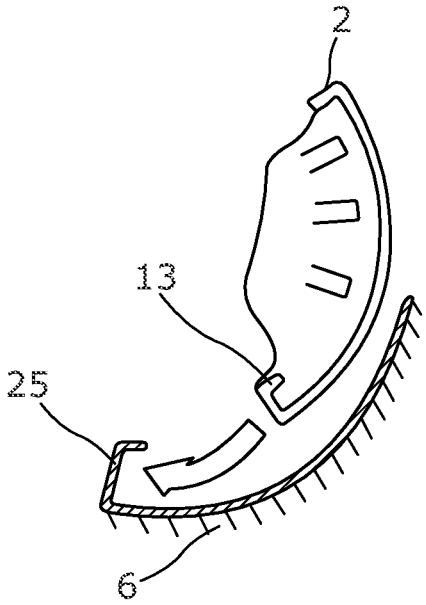
Figure 2B:
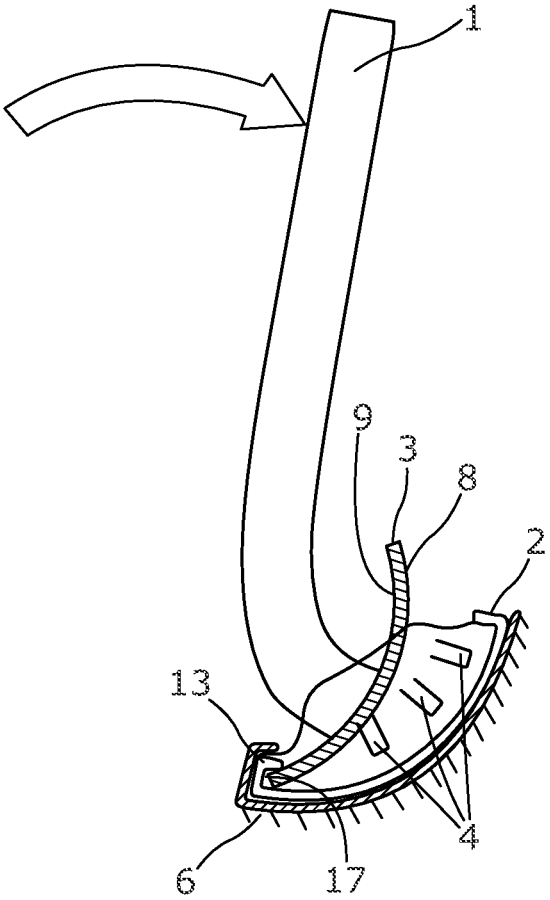

In order that the invention may be more clearly understood embodiments thereof will now be described, by way of example only, with reference to the accompanying drawings, of which:

FIG. 1 shows a schematic lateral cross sectional view of a pedal, pedal cap and pedal cap support according to a first embodiment of the invention;

FIG. 2*a* shows a schematic lateral cross sectional view of the pedal cap of FIG. 1 being introduced into the pedal cap support of FIG. 1;

FIG. 2*b* shows a schematic lateral cross sectional view of the pedal of FIG. 1 being introduced into the pedal cap of FIGS. 1 and 2*a*, held in the pedal cap support of FIGS. 1 and 2*a;*

Figure 2C:
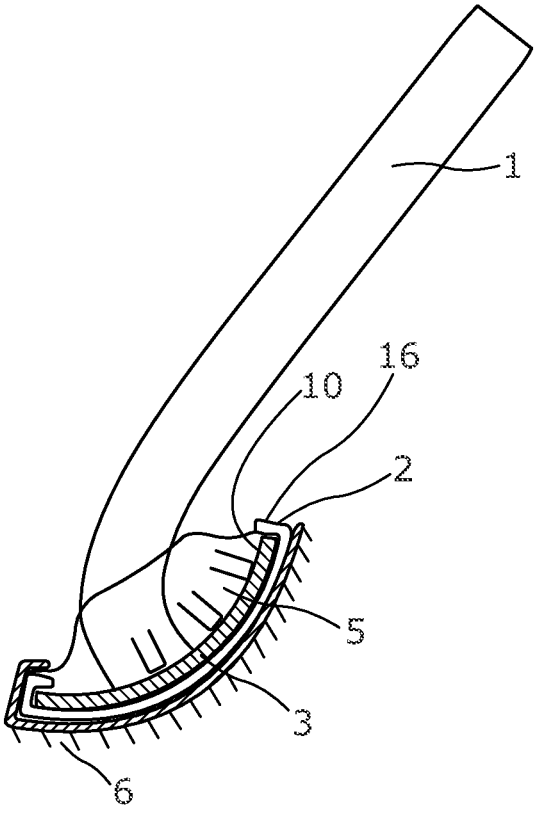

FIG. 2*c* shows a schematic lateral cross sectional view of the pedal of FIGS. 1 and 2*b* inserted into the pedal cap of FIGS. 1-2*b*, held in the support of FIGS. 1-2*b;*

Figure 3A:
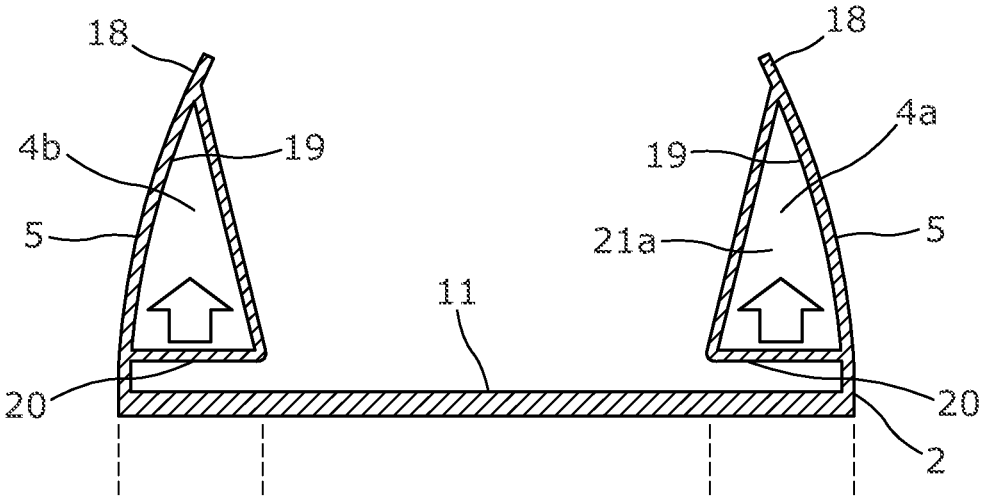

FIG. 3*a* shows a schematic longitudinal cross sectional view of the pedal cap of FIGS. 1-2*c;*

Figure 3B:
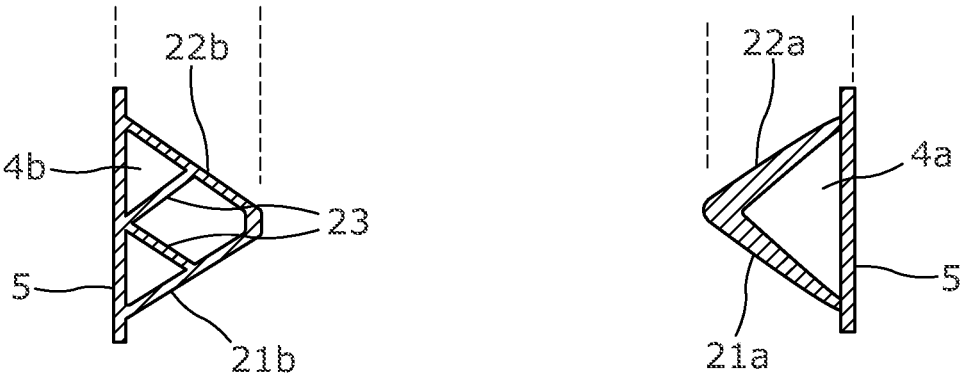
Figure 3C:
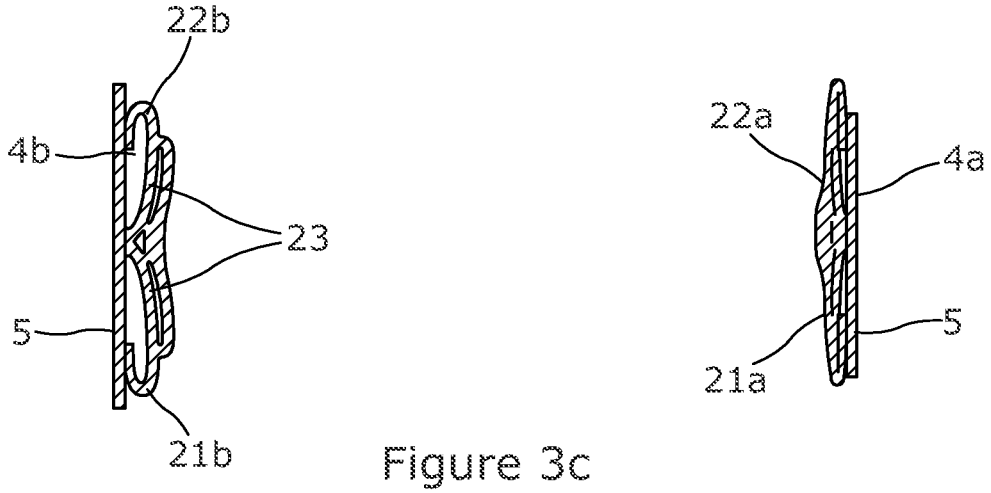
Figure 4:
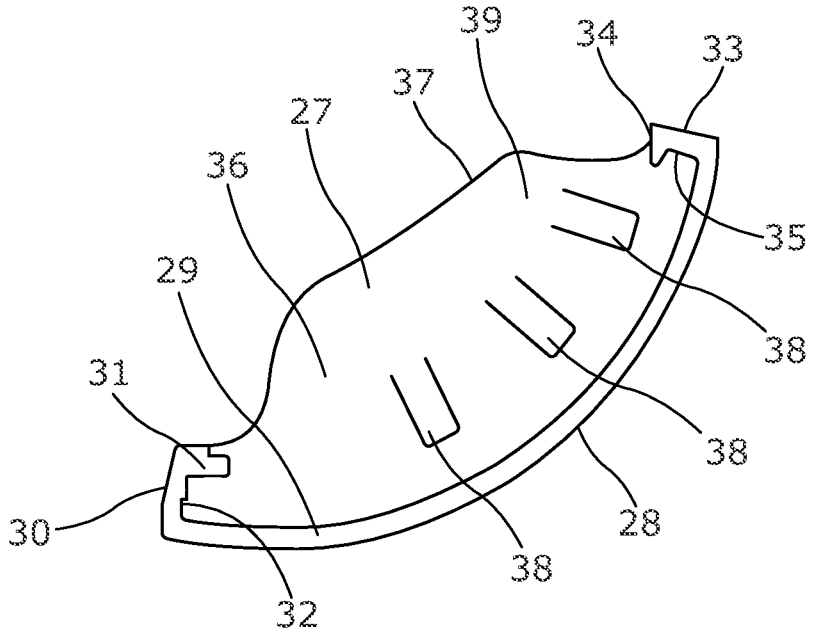

FIG. 3*b* shows a schematic partial cross sectional plan view of two latches of the pedal cap of FIGS. 1-3*a* in the relaxed state;

FIG. 3*c* shows the schematic partial cross sectional plan view of FIG. 3*b*, with the two latches of the pedal cap in the compressed state; and FIG. 4 shows a lateral cross sectional view of a pedal cap according to a second embodiment of the invention.

With reference to FIG. 1, a pedal 1 is shown next to a pedal cap 2 of the first embodiment, which is shaped to conform with the shape of the head 3 of the pedal 1 and has latches 4 on side portions 5 to engage behind the rear of the head 3 of the pedal 1. A support 6 is also provided, into which the pedal cap 2 can be inserted to provide a stable base aiding manipulation of the head 3 into the pedal cap 2.

The pedal 1 comprises an arm 7 with a head (or pedal plate) 3 at its free end. In use, the opposite end will be pivotally attached (hanging or standing) in an automobile (not shown) or similar vehicle, connected via an input rod or the like (not shown) to operate as an accelerator, clutch, brake or the like.

In this embodiment, the pedal 1 is integrally formed from composite material, such as a carbon fibre composite. Consequently, the pedal 1 is lightweight and stirr, but relatively brittle. The head 3 of the pedal in particular is formed as a thin sheet/plate and as a consequence is relatively weak, but of course can withstand normal, indeed vigorous, use.

The head 3 of the pedal 1 is formed with a curved forward surface 8, which in use will face the driver's foot. The rear surface 9 is similarly curved, since the head 3 is formed as a plate. The curve extends from the top 10 to the bottom 17 of the head 3, such that the forward surface 8 is convex and laterally (i.e. between the sides), the head 3 is straight.

The pedal cap 2 is formed as a moulding from a resilient (and high friction) material, e.g. a plastics material such as rubber, or an elastomer. It has a similar plate-like curved body portion 11, which conforms with the shape of the head 3 of the pedal 1 and forms the foot pad, the forward surface of which is pressed by a driver, in use. This forward surface can be individually styled and may, for example, be provided with decorative metal plates.

The curve of the pedal cap 2 has a cross sectional shape substantially constituting a segment of a circle, the segment being slightly less than a quarter of a circle.

Accordingly, the rear surface 12 of the body portion 11 is concave, so as to match the forward surface 8 of the head 3. At the bottom of the body portion 11, an inturned lip 13 is arranged, which extends rearward and has an inwardly extending flange 14 which is substantially parallel to the part of the curved body portion 11 in the region where it is formed, so as to form a groove 15 sized to receive the bottom end 17 of the head 3.

At the opposite (top) end, an upstanding lip 16 is formed, extending rearward, substantially perpendicular to the part of the curved body portion 11 in the region where it is formed. The upturned lip 16 and the inwardly extending flange 14 of the inturned lip 13 are substantially parallel.

At each lateral side of the pedal cap 2, a side portion 5 is formed. The side portions 5, extend between the inturned lip 13 at the bottom of the pedal cap 2 and the upturned lip 16 at its top. The side portions project rearward, away from the rear surface 12 of the body portion 11. Whilst the lips 13, 16 may typically be relatively short, e.g. less than 1 cm high, the side portions 5 project further in the rearward direction, typically at least 2 cm—this reduces the chances of a driver's foot slipping under the pedal.

As shown in FIG. 3*a*, the side portions 5 curve slightly inwardly, such that their rearmost ends 18 are slightly closer together than the ends proximal to the body portion 11 of the pedal cap 2. For example, the rearmost ends could be up to 5 mm inwards.

The aforementioned latches 4 are formed on the inner faces 19 of the side portions 5, and in this embodiment, three latches 4 are provided on each of the two side portions 5, making a total of 6 latches (although obviously the number can be varied).

As can be seen from FIGS. 3*a* and 3*b*, the latches 4 are wedge shaped, becoming broader closer to the body portion 11 and narrower at the each latch 4 is shaped as a triangular based pyramid, with one wall of the pyramid formed by the side portion 5. The bases, or engaging surfaces, 20 of the wedge shaped latches 4 are spaced from the rear surface 12 of the body portion 11 by a dimension substantially equal to the thickness of the plate-like head 3 of the pedal 1.

In this embodiment, the wedge shaped latches 4 are hollow (and formed from the same resilient material as the remainder of the pedal cap 2. Consequently, they can be compressed towards the side portions 5, as shown in FIG. 3*c*.

Two different hollow wedge-shaped latches 4 are shown in FIGS. 3*a-c*. The right hand latch 4*a* is entirely hollow and formed by two triangular sidewalls 21*a*, 22*a*, joined together at one edge and each joined to the side portion 5 at the other edge. The sidewalls 21*a*, 22*a* are tapered, such that each becomes thicker towards the edge where they meet. This tends to encourage the latches to bulge outward, as they are compressed towards the side portions 5 by a force applied by the head 3 of a pedal 1 moving towards the body portion 11 of the pedal cap 2.

The left hand of the cap in FIGS. 3*a-c* is formed from triangular sidewalls 21*b*, 22*b* and is largely hollow, however, a pair of bracing walls 23 extend from half way along each triangular side wall to a common point midway along the side portion 5. In a similar manner to the tapering, these bracing walls 23 prevent the triangular sidewalls from bulging inwardly as they are compressed, and cause them instead to bulge outwardly, allowing the latches 4 to compress into a smaller lateral space.

Of course, in practice, both latches would typically be formed in the same manner, i.e. either both tapered, or both provided with bracing walls 23.

In order to aid insertion of the head 4 of the pedal 1 into the pedal cap 2, as set out above, a support 6 shown in FIGS. 1-2*c* is provided. The support 6 is formed of a strong material and attached by known means to a stable surface. The support 6 is intended to receive the pedal cap 2 therein and consequently is provided with a rear face 24 conforming to the shape of the forward surface of the pedal cap 2. At the base of the support 6, an inturned lip 25 is provided, into which the inturned lip 13 of the pedal cap can be slotted. A cutout 26 is formed in each side portion 5, in order that the inturned lip 13 can be slotted into the inturned lip of the support 6.

With reference to FIG. 2, in order to fit the pedal cap 2 onto the head 3 of a pedal 1, the inturned lip 13 of the pedal cap 2 is introduced into the inturned lip 25 of the support 6 and the front face of the pedal cap 2 is rested on the rear face 24 of the support 6. The bottom end 17 of the head 3 of the pedal 1 is then introduced into the inturned lip 13 of the pedal cap 2, and the arm 7 of the pedal 1 is used as a lever to rotate the pedal 1, such that the head 3 passes and compresses the latches 4 towards the side portions 5 (as shown in FIG. 3*c*). Then, once the rear face 9 of the head 3 of the pedal 1 passes the base of the latches 4, as the front face 8 comes into abutment with the rear face 11 of the pedal cap 2, the latches 4 spring back inwards so as to engage behind the rear surface 9 of the pedal 1.

Once all the latches 4 are engaged, the top 10 of the head 3 of the pedal 1 will be adjacent to the upturned wall 16. Consequently, the inwardly extending lip 13 and the latches 4 restrict the pedal cap 2 from being removed by pulling the pedal cap 2 in the direction away from the forward faces; the upstanding part of the inwardly extending lip 13 restricts the pedal cap 2 from being removed by sliding it upwards (in the direction of the top 10 of the head 3 of the pedal 1); the side portions 5 restrict the pedal cap 2 from being slid off to one side or the other, and the upstanding lip 16 restricts the pedal cap 2 from being removed by sliding the pedal cap 2 downwards (in the direction ofthe bottom 17 of the head 3 of the pedal 1).

Those skilled in the art will appreciate that this is a very gentle manner of introducing the pedal 1 into a pedal cap 2, with no significant stress caused as the bottom 17 of the head 3 is introduced into the pedal cap 2, or as the top 11 is introduced, and only slight stress caused by pressing against the wedge shaped latches 4. It is also substantially easier than introducing the head 3 of a pedal 1 to a conventional pedal cap; can be done with no tools and can be done rapidly, using the pedal arm 7 as a lever, when a suitable support 6 is provided. Nonetheless, despite easy assembly, the cap 2 is securely retained on the pedal 1. The latches 4 also serve to support pedal cap side portions 5, which prevent the driver's foot catching the underside of the pedal while moving between pedals (e.g. from accelerator to brake).

It will also be understood that whilst the support 6 facilitates quick and easy assembly in volume manufacture, it is not essential to assembly. The pedal cap 2 can still be put onto the pedal 1 by hand by a service technician/home mechanic significantly more easily than typical prior art pedal caps.

A second embodiment of a pedal cap 27 is shown in FIG. 4. It will be seen that this is similar to the first embodiment, and again it is formed as a moulding from a resilient plastic material, such as rubber, or an elastomer. It has a similar plate-like curved body portion 28, which conforms with the shape of the head (not shown) of a pedal (not shown) and forms the foot pad, the forward surface of which is pressed by a driver, in use.

The curve of the pedal cap 27 has a cross sectional shape substantially constituting a segment of a circle, the segment in this second embodiment being slightly less than an eighth of a circle.

Accordingly, the rear surface 29 of the body portion 28 is concave, so as to match the forward surface of the head (not shown). At the bottom of the body portion 28, an inturned lip 30 is arranged, which extends rearward and has an inwardly extending flange 31 which is substantially parallel to the part of the curved body portion 28 in the region where it is formed, so as to form a groove 32 sized to receive the bottom end of the head of the pedal (not shown).

At the opposite (top) end, in this second embodiment, another inturned lip 33 is formed, extending rearward, substantially perpendicular to the part of the curved body portion 28 in the region where it is formed, with an inwardly extending flange 34 which is substantially parallel to the part of the curved body portion 28 in the region where it is formed, so as to form a second groove 35 sized to receive the top end of the head of the pedal (not shown). In view of the relatively shallow curve of the body portion 28, the inwardly extending flanges 31, 34 are face generally towards each other.

At each lateral side of the pedal cap 27, a side portion 36 is formed. The side portions 36, extend between the inturned lip 30 at the bottom of the pedal cap 27 and the upturned lip 33 at its top. The side portions project rearward, away from the rear surface 29 of the body portion 27. Whilst the lips 30, 33 may typically be relatively short, e.g. less than 1 cm high, the side portions 36 project further in the rearward direction, typically at least 2 cm—this reduces the chances of a driver's foot slipping under the pedal.

The schematic FIGS. 3*a* to 3*b* apply equally to the second embodiment as to the first. Again, the side portions 36 curve slightly inwardly, such that their rearmost ends 37 are slightly closer together than the ends proximal to the body portion 28 of the pedal cap 27. For example, the rearmost ends could be up to 5 mm inwards.

Latches 38 are formed on the inner faces 39 of the side portions 36, and are identical to those of the first embodiment described in relation to FIGS. 3*a* to 3*c*.

In order to aid insertion of the head of a pedal (not shown) into the pedal cap 27, a support similar to that described in relation to the first embodiment shown in FIGS. 1-2*c* would be provided.

In order to fit the pedal cap 27 onto the head of a pedal (not shown), the bottom inturned lip 30 of the pedal cap 27 is introduced into an inturned lip of the corresponding support (not shown). The bottom end of the head of the pedal not shown) is then introduced into the bottom inturned lip 30 of the pedal cap 27, and the arm of the pedal is used as a lever to rotate the pedal, such that the head passes and compresses the latches 4 towards the side portions 36 Then, once the rear face of the head of the pedal passes the base of the latches 38, as the front face comes into abutment with the rear face of the pedal cap 27, the head is maneuvered into the groove 35 at the top of the pedal cap 27 and the latches 38 spring back inwards so as to engage behind the rear surface of the pedal.

Once all the latches 38 are engaged, the top of the head of the pedal will be held in the top groove 35. Consequently, the bottom inwardly extending flange 31, the latches 38 and the top inwardly extending flange 34 all restrict the pedal cap 2 from being removed by pulling the pedal cap 2 in the direction away from the forward faces; the upstanding parts ofthe inwardly extending lips 30, 33 restrict the pedal cap 2 from being removed by sliding it upwards or downwards; and the side portions 5 restrict the pedal cap 2 from being slid off to one side or the other.

Those skilled in the art will appreciate that this again is a gentle manner of introducing the pedal into a pedal cap 27. It is also substantially easier than introducing the head of a pedal to a conventional pedal cap; can be done with no tools and can be done rapidly, using the pedal arm as a lever, when a suitable support is provided.

The above embodiments are described by way of example only. Many variations are possible without departing from the scope of the invention as defined in the appended claims.

The invention claimed is:

1. A pedal cap comprising a foot pad having a forward surface and a rear surface; the pedal cap further comprising a top surface, a bottom surface, and a pair of parallel, opposing side portions extending rearwardly from the foot pad, away from the forward surface and wherein the pair of side portions each comprise a plurality of latch members, each latch member formed on, and extending from, the pair of side portions, and a pair of opposing lips connecting the pair of side portions; whereby when applying the pedal cap to a pedal having a head and a rear surface, pushing the head of the pedal past the side portions, towards the rear surface of the pedal cap causes the latch members to retract, and once the rear surface of the pedal cap abuts the head of the pedal, the latch members engage behind the rear surface of the pedal.

2. A pedal cap according to claim 1 wherein each side portion is inwardly curved.

3. A pedal cap according to claim 1 wherein each latch member is formed of a resilient material.

4. A pedal cap according to claim 1 wherein each latch member is wedge shaped.

5. A pedal cap according to claim 1 wherein each latch member is pyramidal.

6. A pedal cap according to claim 1 wherein each latch member is hollow.

7. A pedal cap according to claim 1 wherein each latch member is formed with tapering sidewalls and/or bracing walls so as to cause each latch member to bulge outwards when compressed.

8. A pedal cap according to claim 1 wherein at least one lip of the pair of lips is an inturned lip comprising an inwardly extending flange.

9. A pedal cap according to claim 1 wherein at least one lip of the pair of lips is an upturned lip, formed without an inwardly extending flange.

10. A pedal cap according to claim 1 wherein both lips of the pair of lips are inturned.

11. A pedal cap according to claim 1 wherein a first lip of the pair of lips has an inwardly extending flange at one end, a second lip of the pair of lips is without an inwardly extending flange at the other end.

12. A pedal cap according to claim 11 wherein the second lip and the inwardly extending flange of the first lip are substantially parallel.

13. A pedal cap according to claim 1 which is curved, wherein the curve of the pedal cap is concave.

14. A pedal cap according to claim 13 wherein the curve of the pedal cap has a cross sectional shape constituting a segment of a circle, wherein the segment is less than a quarter of a circle.

15. A pedal cap support for supporting a pedal cap according to claim 1; wherein the pedal cap support has a rear face conforming to the shape of the forward surface of the pedal cap, wherein each of the pair of lips is selected from an upstanding lip and an inturned lip.

16. A pedal comprising the pedal cap according to claim 1.

17. An automobile comprising the pedal and the pedal cap according to claim 16.

18. A kit of parts comprising a pedal cap comprising a foot pad having a forward surface and a rear surface; the pedal cap further comprising a top surface, a bottom surface, and two opposing side portions extending rearwardly from the foot pad, away from the forward surface and wherein the side portions each comprise a plurality of latch members, each latch member formed on, and extending from, the side portions; whereby when applying the pedal cap to a pedal having a head and a rear surface, pushing the head of the pedal past the side portions, towards the rear surface of the pedal cap causes the latch members to retract, and once the rear surface of the pedal cap abuts the head of the pedal, the latch members engage behind the rear surface of the pedal; and a pedal cap support for supporting the pedal cap; wherein the pedal cap support has a rear face conforming to the shape of the forward surface of the pedal cap.

19. A method of fitting a pedal cap to a head of a pedal; the pedal cap comprising a foot pad having a forward surface and a rear surface and further comprising a top surface, a bottom surface, and two opposing side portions extending rearwardly from the foot pad, away from the forward surface and wherein the side portions each comprise a plurality of latch members, each latch member formed on, and extending from, the side portions; the method comprising supporting the pedal cap in a pedal cap support; wherein the pedal cap support has a rear face conforming to the shape of the forward surface of the pedal cap and pressing the head of the pedal past each latch on the side portions of the pedal cap, so as to secure the pedal cap to the head of the pedal.

* * * * *